US006017474A

United States Patent [19]

Teo et al.

[11] Patent Number: 6,017,474

[45] Date of Patent: Jan. 25, 2000

[54] HIGHLY PERMEABLE POLYETHERSULFONE HOLLOW FIBER MEMBRANES FOR GAS SEPARATION

[75] Inventors: Wah Koon Teo; Kang Li; Dongliang Wang, all of Singapore, Singapore

[73] Assignee: National University of Singapore, Singapore

[21] Appl. No.: 09/100,013

[22] Filed: Jun. 19, 1998

[30] Foreign Application Priority Data

Jun. 21, 1997 [SG] Singapore ..... 9702118

[51] Int. Cl.[7] ..... D01D 5/247

[52] U.S. Cl. ..... 264/41; 264/129; 264/178 F; 264/184; 264/209.1; 264/211.14; 264/211.16; 264/559; 264/561; 264/562; 264/563; 427/245

[58] Field of Search ..... 264/41, 129, 178 F, 264/184, 209.1, 211.14, 211.16, 559, 561, 562, 563; 427/245

[56] References Cited

U.S. PATENT DOCUMENTS

| | | |
|---|---|---|
| 3,133,132 | 5/1964 | Loeb et al. . |
| 4,230,463 | 10/1980 | Eichhorn et al. . |
| 4,871,494 | 10/1989 | Kesting et al. . |
| 4,902,422 | 2/1990 | Pinnau et al. . |
| 4,992,221 | 2/1991 | Malon et al. . |

OTHER PUBLICATIONS

Wang et al., Journal of Membrane Science 115 (1996) 85–108 (Published Jun. 26, 1996).

Wang et al., *Journal of Applied Polymer Science*, vol. 50, pp. 1693–1700 (1993).

Kumazawa et al., *Journal of Polymer Science: Part B*, Polymer Physics, vol. 31, pp. 881–886 (1993).

*Primary Examiner*—Leo B. Tentoni

*Attorney, Agent, or Firm*—Birch, Stewart, Kolasch & Birch, L.L.P.

[57] ABSTRACT

Formulation polymer dopes and development of processes for preparing asymmetric polyethersulfone hollow fiber membranes for gas separation are provided. Polyethersulfone hollow fiber membranes which exhibit improved gas permeability and selectivity have been produced from a formulated polymer dope containing N-methyl-2-pyrrolidone (NMP) and suitable nonsolvent-additives (NSA). The nonsolvent-additives are water and the mixture of ethanol and water. The dopes were tailored to be close to the point of phase separation, and have moderate polymer concentration with moderate viscosity. The hollow fibers were spun by the dry-wet phase inversion processes using water as both the internal and external coagulant. The dried hollow fibers are then coated with silicone rubber, a highly permeable material and the coated hollow fiber membranes exhibit excellent permeability and selectivity compared to those of the state-of-the-art polyethersulfone membranes.

19 Claims, No Drawings

HIGHLY PERMEABLE POLYETHERSULFONE HOLLOW FIBER MEMBRANES FOR GAS SEPARATION

BACKGROUND OF THE INVENTION

1. Field of the Invention

This invention relates to polyethersulfone asymmetric hollow fibers with improved gas permeability and selectivity. In another aspect, the invention relates to formulating polymer dopes containing the polymer, an organic solvent, and a suitable additive that is a polar compound ("nonsolvent-additive"). Polymer dopes of the invention have moderate polymer concentrations and viscosities as well as low coagulation valves. In yet another aspect, the invention relates to the process of producing asymmetric hollow fibers for gas separation.

2. Description of Related Art

References of the scientific periodical and patent literature are cited throughout this specification. Each such literature reference is hereby incorporated in its entirety by such citation.

There are three key parameters that determine the commercial viability of a membrane for gas separation. The first is its separation factor towards the gases to be separated and this directly controls the degree of the separation and indirectly determines the membrane area requirement. The second parameter is membrane permeation flux which simply dictates the membrane area requirement. The third is the working life of membrane. The separation factor depends mainly on the membrane materials. It has been shown that polyethersulfone exhibits superior selectivity compared to polysulfone and cellulose acetate which have been used to produce commercial gas separation membranes. Polyethersulfones also have good thermal resistance and mechanical strength, but display only moderate permeability. The challenge to the production of polyethersulfone gas separation membranes suitable for industrial applications is the fabrication of this polymer into membranes having high permeation flux. The gas permeation rate through a dense polymer membrane is proportional to the pressure difference across the membrane, its membrane area and the permeability coefficient of the membrane material, and inversely proportional to the membrane separating layer thickness. Of these parameters, the permeability coefficient depends on the nature of polymer material; and pressure difference is the operating condition. The goal in membrane making is therefore, to prepare membranes with an ultra thin separating layer and enhancement of membrane area and mechanical strength.

To provide maximum membrane area and minimum separating layer thickness, asymmetric hollow fiber membranes are the favorite choices. Hollow fiber membranes which can provide the maximum area per unit packing volume is the most important membrane configuration. A process for producing asymmetric hollow fibers typically includes the following steps: (1) formulating a polymer dope; (2) extruding from the orifice of a tube-in-orifice spinnerette suitable for forming a hollow fiber configuration; (3) meanwhile, an internal coagulant (a nonsolvent for polymer) is injected into the tube of the spinnerette in order to maintain the bore configuration; (4) the nascent hollow fiber passes through an air-gap; (5) the hollow fibers are immersed into the coagulation bath so as to leach out the solvent or additive in the nascent fibers to produce an asymmetric structure by forming a thin dense skin supported by a thick and more porous sublayer; (6) removing the fibers from the coagulation bath; and (7) drying of the fibers.

Asymmetric membranes have good possibility in forming very thin separating layers. The method for producing this kind of membrane by the phase inversion process was first invented by Loeb and Sourirajan (U.S. Pat. No. 3,133,132). These asymmetric membranes were soon used in industrial liquid separation processes such as reverse osmosis and ultrafiltration. However, these membranes prepared from non-cellulose polymers often exhibit poor selectivity for gas separation due to the presence of bigger pores on the membrane surface and because the transport of gas is largely due to Knudsen flow and viscous flow.

U.S. Pat. No. 4,230,463 issued to Henis and Tripodi describes a method to seal the big pores by coating a thin silicone rubber film on the surface of asymmetric membranes. The separation properties of these composite asymmetric membranes are generally determined by the material of the asymmetric membrane instead of the material of the coating. Development of this kind of membrane allowed large-scale commercial applications of gas separation using asymmetric membranes.

Unlike flat-sheet membranes which require a solid support, hollow fibers are self-supporting. The polymer dope used for spinning of hollow fibers must be of sufficiently high viscosity and polymer concentration in order to produce a self-support extrusion prior to a coagulation process. However, too high a viscosity of the polymer dope is undesirable as it causes difficulty in spinning. The spinning process involves many variables which affect the structure of the membrane and its gas separation characteristics. These variables include polymer dope composition, spinning conditions and coagulation conditions. The nature of polymer dope is highly influential in determining the morphology of the hollow fiber membrane and its gas separation properties.

U.S. Pat. No. 4,871,494 issued to Kesting et al. describes a process for forming asymmetric gas separation hollow fiber membranes having graded density skins. This process comprises dissolving a hydrophobic polymer in Lewis acid/Lewis base complexes wherein the Hildebrand parameters of the solvent system and the polymer are less than 1.5 $cal^{0.5}/cm^{1.5}$. The useful acids employed as additives must have the Gutman acceptor number (AN) of $47<AN<63$, and the infra-red frequency shifts ($\Delta\nu$) of a complex with N-methyl-2-pyrrolidone falling within the range of $-25<\Delta\nu<-38$ cm. The solubility parameters of useful acids have been found to have values of $12<\delta<12.5$ $cal^{0.5}/cm^{1.5}$. The polymer dope has a high polymer concentration (35 wt %–40 wt %), high viscosity (>100,000 cp) and a low coagulation value ($0<Gv<1.5$ g). A suitable choice of acid (e.g. propionic acid) results in the hollow fibers exhibiting high permeabilities and good potential for high separation factors. The development of this kind of membrane has led to the production of the commercial gas separator Perme-$\alpha$.

U.S. Pat. No. 4,992,221 issued to Malon et al. discloses a process for preparing asymmetric polymers hollow fibers with improved separation factor and mechanical strength. The membranes were produced from a process utilizing membrane forming dopes of solvent systems formulated from two nonsolvents and one solvent. The nonsolvents were chosen according to the nonsolvent strength, i.e. one strong nonsolvent and one weak nonsolvent which were combined with solvent in an acid:base complex solvent system. A strong nonsolvent is defined as one having a $\Delta\delta(\delta_{nonsolvent}-\delta_{polymer})\geqq 6$ $cal^{0.5}/cm^{1.5}$. A weak nonsolvent is defined as one with a $\Delta\delta<6$ $cal^{0.5}/cm^{1.5}$.

Pinnau et al. (U.S. Pat. No. 4,902,422) discloses a process to prepare "defect-free" asymmetric flat-sheet membranes by the dry/wet phase inversion process. Highly permeable asymmetric membranes were prepared by selecting suitable polymer dopes and coagulants as well as controlling conditions of the drying process so as to form a dense skin separating layer.

It is known in the art to make polyethersulfone hollow fiber gas separation membranes from 1:1 molar mixtures of N-methyl-2-pyrrolidone (NMP): proprionic acid, a Lewis acid:base complex and high polymer concentration. Such a process has been patented (U.S. Pat. No. 4,871,494). However, the use of solvent systems containing a polar liquid or a mixture of polar liquids as a nonsolvent-additive for improved gas separation performance of polyethersulfone hollow fibers has not previously been known.

SUMMARY OF THE INVENTION

An important object of the invention is a formulation of a polymer dope and a process for forming polyethersulfone asymmetric hollow fibers having improved permeability and separation factor. The polymer dope has moderate polymer concentration, moderate viscosity and low coagulation value. The polymer dope contains at least polyethersulfone or a derivative thereof, a solvent and at least one nonsolvent-additive. The nonsolvent additive is a material in which the polyethersulfone or derivative thereof is not soluble. As the nonsolvent-additives, either strong nonsolvents or weak nonsolvents are chosen. Nonsolvent-additives are preferably polar compounds that are liquid at room temperature and include water and ethanol.

Another object of the present invention is to provide improved polyethersulfone hollow fiber membranes which can be used for gas separation by selecting a suitable nonsolvent-additive and its concentration in the formulation of polymer dopes.

Another object of the present invention is to provide a process for preparing such improved asymmetric hollow fiber membranes.

It is a feature of the preceding objects that the viscosities of polymer dopes can be adjusted by the introduction of a suitable nonsolvent-additive into the polymer dope.

In the process of this invention, all the polymer dopes have their compositions close to the point of incipient phase separation with coagulation values falling within the range of 1.0–3.0 g using water as a coagulant. The formulation of the polymer dope composition is based on Eqn. (1) which relates the mass ratio of nonsolvent-additive to solvent(Ra/s) and its coagulation value (Gv) (Wang et al. J. Membrane Sci., vol.98, (1995) 233–240). This equation is expressed in terms of the precipitation values of the nonsolvent-additive and the coagulant in the binary polymer-solvent system (Wang et al., J.Appl. Polym.Sci., vol. 50 (1993) 1693–1700.

$$Ra/s = \frac{\frac{98}{100}PV_a - \frac{PV_a}{PV_c}Gv}{98 + \frac{PV_a}{PV_c} - Gv}$$

In Eqn. (1), $PV_a$ is the precipitation value of nonsolvent-additive (g); $PV_c$ is the precipitation value of coagulant (g); $R_{a/s}$ is the mass ratio of nonsolvent-additive to solvent in the polymer dope and Gv is the coagulation value (g).

The hollow fibers are spun by the dry-wet phase inversion process using water as the internal and external coagulants. The dried hollow fibers are then coated with a highly permeable material (silicone rubber).

DETAILED DESCRIPTION OF THE INVENTION

The present invention comprises a method to produce ultrathin-skinned asymmetric polyethersulfone hollow fibers which have higher ideal gas separation factors and permeabilities than those produced from other solvent systems utilized for producing polyethersulfone hollow fibers for gas separation. The hollow fibers of the present invention were produced from the polymer dopes containing N-methyl-2-pyrrolidone (NMP) and also containing a suitable nonsolvent-additive. The nonsolvent-additives used are polar liquids and mixtures thereof. Preferred nonsolvent-additives are water and linear $C_1$–$C_4$ alcohols. Most preferred as the nonsolvent-additives are water and ethanol or a mixture thereof. Mixtures of nonsolvent-additives can be binary or ternary mixtures. The mixture of solvent and nonsolvent-additive is capable of dissolving a suitable concentration of polymer, and is easily evaporated during the drying process and rapid desolvation during the coagulation step. When these hollow fibers were coated with a highly permeable material such as silicone rubber, the hollow fibers exhibit improved permeability and separation factor in comparison with those of state-of-the-art polyethersulfone membranes.

Advantages of this invention are as follows: the process of the invention has excellent reproducibility; it is an economic process allowing production of reliable hollow fibers in large quantities; the material for making the membranes is commercially available and has excellent selectivity as well as thermal and mechanical stability; the nonsolvent-additives used are common and exhibit little toxicity.

The hollow fibers formed by the process of this invention have thin outer and inner skin layers supported by an interconnected microporous sublayer with very little resistance to gas flow. The hollow fiber membranes with a range of "sponge-like" to "finger-like" sublayer structure could be fabricated by selecting a suitable nonsolvent-additive. A change of nonsolvent-additive resulted in the membrane having different structure. The "sponge-like" structure enhanced the yield stress of the hollow fibers and also pressure tolerance. The skin layer is so thin that it is beyond the measurement of scanning electron microscopy. The apparent effective skin thickness estimated from measured gas permeability and reported permeability coefficient data of dense films formed from the same polymers ranges from 400 Å to 500 Å. Between the outer and inner skin layer lies a very open porous support of complex morphology, easily seen by scanning electron microscopy.

The process of the present invention uses polyethersulfones as the membrane material. Polyethersulfone which forms the membrane of this invention consists essentially of repeating units having the general formula:

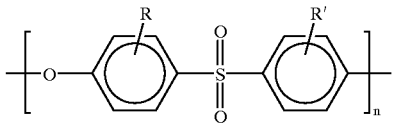

wherein R and R' are optionally present and can be the same or different. R and R' are selected from the group consisting of hydrogen, linear $C_1$–$C_4$ alkyl, branched $C_1$–$C_4$ alkyl and halogen groups. Preferred alkyl groups are methyl and ethyl and preferred halogens are Cl and F. More than one, but preferably no more than three R and/or R' groups can be present.

The most preferred polymer is underivatized polyethersulfone, that is, the compound of formula (1) wherein both of R and R' are absent. This polymer is commercially available as VITREX® (I.C.I. America, Inc.) and RADEL (Amoco Performance Products, Inc.). Polyethersulfone has superior selectivity for separating oxygen from nitrogen (Haraya et al., J. Membrane Sci., 71(1992)13) and separating helium, hydrogen and carbon dioxide from nitrogen and methane (Kumazawa et al., J. Polym. Sci., Part B: Polymer Physics, 31(1993)881; Chion et al., J. Appl. Polym. Sci., 33(1987)1823; Wang et al., J. Membrane Sci., 105(1995)89). It also has good thermal resistance ($T_g$=220° C.) and mechanical stability (Harris et al., Encyclopedia of Polymer Sci. and Eng., Polysulfone, Wiley: New York, 13(1988)203).

A unique aspect of this invention was the realization of the importance of choice of nonsolvent-additive in producing hollow fiber membranes by the dry/wet phase inversion process. In selecting a nonsolvent-additive, it is of primary importance to select one with good mutual affinity with solvent and coagulant. A good nonsolvent-additive should also have a suitable volatility in order to evaporate upon an exposure on the nascent membrane surface so as to increase polymer concentration during the dry process, particularly if the solvent used has a low volatility. The formation of hydrogen-bond complexes of solvent and nonsolvent-additive is favorable to increase polymer dope viscosity and results in improved membrane properties. Therefore, the nonsolvent-additive plays a very important role in membranes making according to the invention. Selection of a suitable nonsolvent-additive is thus very important. In preferred embodiments of this invention, water and ethanol which possess the above-mentioned properties were selected as nonsolvent-additives. Of these nonsolvent-additives, water, in particular, forms a strong hydrogen-bond complex with N-methyl-2-pyrrolidone (NMP).

In producing the asymmetric hollow fibers having graded density skins, several parameters have been used to choose a nonsolvent-additive based on the concept of Lewis acid:Lewis base complexes (Kesting et al., U.S. Pat. No. 4,871,494). These include Gutman acceptor number (AN) for the strength of Lewis acids and the infrared (IR) frequency shifts ($\Delta\nu$) of the carbonyl (C═O) bands of amides for the strength of the acid:base complexes formed. According to Kesting's view, acids which yield the most useful complexes appear to fall in the range 47<AN<63 and have a $\Delta\nu$ of −25 to −38 $cm^{-1}$. To date, the only acceptable acids which have been found are propionic acid, acetic acid and butyric acid with propionic acid as the best overall choice. In contrast, the Gutmann acceptor number (AN) of the nonsolvent-additives used in this invention and their $\Delta\nu$ with N-methyl-2-pyrrolidone as listed in Table 1 are mostly outside the range recommended by Kesting et al. These nonsolvent-additives were apparently not considered as good additives in U.S. Pat. No. 4,871,494.

TABLE 1

| | AN | $\Delta\nu$ $cm^{-1}$ |
|---|---|---|
| Water | 54.8 | −5 to −10 |
| Ethanol | 37.1 | — |

The desired concentration of a nonsolvent-additive in the polymer dope depends on the nature of polymer, solvent and nonsolvent-additive as well as temperature. Nonsolvents are categorized as strong nonsolvents and weak nonsolvents in terms of Hansen solubility parameter difference ($\delta_{nonsolvent}$−$\delta_{polymer}$). A strong nonsolvent is defined as one having a $\Delta\delta$>6 $cal^{0.5}/cm^{1.5}$. A weak nonsolvent is defined as one with a $\Delta\delta$<6 $cal^{0.5}/cm^{1.5}$. It was reported that when a strong nonsolvent has low tolerance in the polymer dope, higher concentration of weak nonsolvent can be incorporated (Malon et al., U.S. Pat. No. 4,992,201). In practice, it has been found that this rule is not universally correct (Wang et al., J. Appl. Polym. Sci., 50(1993)1693). For example, the solubility parameter of ethylene glycol is 17 $cal^{0.5}/cm^{1.5}$. Ethylene glycol is a strong nonsolvent for polyethersulfone. However, the tolerant concentration of ethylene glycol added in the polyethersulfone/N-methyl-2-pyrrolidone solution is nearly the same with that of aliphatic alcohols which are weak nonsolvents. It was demonstrated that the precipitation value of nonsolvent in the polymer/solvent system defined is more precise in the determination of concentration of nonsolvent-additive in the polymer dope. A nonsolvent-additive with a higher precipitation value can be introduced in a higher concentration in the polymer dope. According a Eqn. (1), the maximum mass ratio of nonsolvent-additive to solvent $(R_{a/s})_{max}$ is the value when the coagulation value is zero. A mass ratio of nonsolvent-additive to solvent in the range of O-$(R_{a/s})_{max}$ may be required to achieve the desirable composition for a given coagulation value. The mass ratio of nonsolvent-additive to solvent in the polymer dope can be determined using eqn. (1) for a desirable coagulation value. The choice of coagulation value depends on the precipitation value (PV) of the additive, temperature and interaction of the polymer-solvent-nonsolvent-additive system. For $C_1$–$C_4$ aliphatic alcohols the PV values are quite similar; the desirable coagulation values are between 0.5–1.5 g; and the mass ratio of nonsolvent-additive to solvent are in the range of 0.47–0.37.

The polymer concentration of the polymer dope must be sufficiently high to produce the hollow fiber membranes with dense surface separating layer and good mechanical support layer for gas separation. A polymer concentration of about 25%–50% by weight in the dope may be needed to achieve the resulting membranes with desirable separation factor and mechanical strength. Too high a polymer concentration tends to form membranes having low permeability and causes difficulty in the spinning of hollow fiber membranes due to high viscosity, whereas membranes produced from low polymer concentration have low selectivity and poor mechanical strength. A preferred range of polyethersulfone concentration is 25 wt % to 40 wt %. The optimum concentration range is 25 wt % to 35 wt %. The desirable polymer concentration depends also on the solvent and nonsolvent-additive used and operating conditions of resulting membranes.

Viscosity has a significant effect in the spinning of hollow fiber membrane. Too high a viscosity is not suitable for fabricating hollow fibers at room temperature, whereas a low viscosity has a detrimental effect on hollow fiber formation. In this invention, the polymer dopes have viscosities ranging from 5000 cp to 50,000 cp at 25° C. which are much smaller than those used in U.S. Pat. No. 4,871,494. The viscosity of the polymer dope increases with increasing concentrations of the polymer and the viscosities of solvent and nonsolvent-additive. However, the hollow fibers spun from high polymer concentrations tend to exhibit low permeability. On the other hand, the diffusion rate of the liquid decreases with increasing its viscosity. This behavior is not desirable for making membranes for gas separation.

The desirable viscosity may be achieved by the selection of a suitable nonsolvent-additive which forms hydrogen-bond complex with solvent. The formation of this complex greatly increases the viscosity of the solvent system which in turn causes the viscosity of the polymer dope to increase dramatically. In this invention, the formation of the complex of water and N-methyl-2-pyrrolidone yields polymer dopes with high viscosity.

In producing integrally-skinned asymmetric hollow fibers issued by Kesting et al. (Kesting et al., U.S. Pat. No. 4,871,494), higher polymer concentration (>30 wt %), higher polymer dope viscosity (>$10^5$ cp) at 25° C. and higher mass ratio of nonsolvent-additive to solvent in the polymer dope are necessary conditions to produce membranes with high permeability and selectivity. In the process of the invention, the polyethersulfone hollow fiber membranes with improved permeability and selectivity can be produced from a polymer dope having a moderately high polymer concentration, moderately high viscosity and low mass ratios of nonsolvent-additive to solvent.

The polymer dope temperature is typically between about 0° C. to 100° C., preferably 20° C. to 50° C., but the optimum temperature is usually room temperature considering economic and operation factors.

In a phase inversion process for making membranes, the dry process is very important to form the dense outer layer. During this process, the polymer concentration on the surface of the nascent membrane may increase due to the evaporation of solvent and nonsolvent-additive. At the same time, the absorption of moisture may result in phase separation, particularly when the polymer dope has a composition close to the point of phase separation. On the other hand, coalescence and deformation of polymer aggregates induced by the surface tension also play an important role in forming dense skin layer. This process is important to the formation of an asymmetric hollow fiber membrane having thin, dense outer layer. The effect of the dry process mainly depends on the volatility of solvent and nonsolvent-additive, temperature in the membrane making environment as well as the surface tension of the nascent membrane. A solvent and nonsolvent-additive with low boiling point are optimally selected for the sake of forming the dense skin. Unfortunately, solvents with good water miscibility which dissolve polyethersulfones usually have low volatility because of a high degree of polarity and hydrogen bonding. For the present invention, one selects one solvent which can dissolve polyethersulfones and has a good affinity with water as well as high volatility. N-methyl-2-pyrrolidone is often considered as a good solvent for making polyethersulfone asymmetric membranes, but has high boiling point (202° C.). However, other n-lower alkyl, preferably $C_1$–$C_4$ lower alkyl pyrrolidones, can be considered. In order to increase the surface concentration of the nascent hollow fibers, the nonsolvent-additives with suitable volatility are preferred.

The air-gap is generally kept about 0–50 cm, preferably about 5–25 cm. The air-gap should be optimized to produce the best asymmetric hollow fibers; the optimal gap will depend upon many factors, including the polymer used, the boiling points of the solvent system, the rate of spinning, the wall thickness of hollow fibers, the coagulant used in the internal and the temperature of dope and membrane making environment.

The kinetics of gelation and desolvation during the coagulation process is another key parameter in producing asymmetric hollow fibers exhibiting high permeability as well as mechanical stability. This is true because the skin layer thickness and porosity depends on the surface polymer concentration and how rapidly the solvent and nonsolvent-additive in the polymer dope is removed from the polymer dope, and the coagulant is transferred into the nascent membrane. One important factor that controls phase separation kinetics is the coagulant tolerance of the polymer dope, that is, how close the polymer dope is to the precipitation point. The closer the polymer dope is to the precipitation point, the faster the phase inversion will occur and the thinner the skin layer thickness will be. Because it is difficult to determine experimentally the coagulant tolerance of a highly viscous solution, a dilute solution of polymer in a given solvent is employed instead. The coagulation value (Gv) is used to indicate the coagulant tolerance of the polymer dope, which has been defined as the grams of coagulant required to make 100 g of 2 wt. % polymer solution turbid at a given temperature. By adding a nonsolvent-additive into the polymer dope, the coagulation value decreases until the coagulation value is zero. When the coagulation value reaches zero, phase separation of the polymer dope occurs and no asymmetric membranes can be prepared. This relationship between the mass ratio of nonsolvent-additive to solvent and its coagulation value is described by Eqn. (1).

A feature of the invention is the formulation of polymer dopes with suitable coagulation values by the introduction of a nonsolvent-additive for making the desirable hollow fibers with improved permeability and selectivity. This allows the coagulation process to occur at an extremely rapid rate and prevents formation of large unsealable surface pores and thick skin layer. The choice of the coagulation value is determined by the precipitation values of nonsolvent-additive and coagulant and the interactions of polymer/solvent/nonsolvent-additive. Usually, the dissolving power of solvent system for a polymer declines with increasing polymer concentration due to interactions of polymer and the constituents of the solvent system. It is generally believed that coagulation values are different for different solvent systems, and they depend on the interaction parameter of the solvent system and polymer, which is concentration dependent. A higher coagulation value is expected for the system with a stronger interaction parameter compared to that with the weaker interaction parameter concentration-dependence even if the polymer dopes are close to the precipitation point at relatively high polymer concentration. In making polyethersulfone hollow fibers in accordance with this invention a typical polymer dope has a coagulation value within the range of 25–35% $(Gv)_{max}$ C (C is polymer concentration in weight).

Another important factor which controls the rates of gelation and desolvation during the wet coagulation process is the mutual miscibility of the solvent system and the coagulant. Many nonsolvents for a given polymer can be used as coagulant. Water is favorable from economic and environmental viewpoints. Therefore, the solvent and nonsolvent-additive selected must be easily dissolved in water. When the nascent hollow fiber is immersed into a water bath, quick coagulation and fiber solidification occur.

The temperature of water bath can be varied from 0° C.–100° C., preferably the temperature is from 20° to 50° C. The most favorable temperature is room temperature. Solvent and/or nonsolvent-additive remaining after the fiber leaves the water bath is washed away by a water spray at room temperature. The washing period is at least 3 days, preferably 3 or 4 days.

After the hollow fiber has been dried, it must be coated with a highly permeable material to seal the big pores on the fiber surface. Without such a coating, the fiber will not have the desired high separation factor. One of the coating materials is silicone rubber (SYLGARD-184

(polydimethylsiloxane), Dow Corning). Concentrations of coating solutions vary from 1 to 10 wt %, preferably about 2–6 wt %.

The hollow fibers of the present invention are suitable for use in membranes for separating oxygen and nitrogen from air, helium, hydrogen and carbon dioxide from nitrogen, and methane.

GENERAL MATERIALS AND METHODS

Any means for forming a hollow fiber from the polymer dope can be employed. A preferred hollow fiber forming means is a tube-in-orifice spinnerette. All of the hollow fibers prepared in the examples below were made by the dry-wet spinning process. The mass ratio of nonsolvent-additive to solvent in the polymer dope was determined using Eqn. (1) for a given coagulation value. The mixture of solvent and nonsolvent-additive was prepared according to the calculated mass ratio. The polymer, polyethersulfone (VITREX®, 4800P or RADEL A-300) was then added into this liquid mixture to make the polymer dope with a desirable polymer concentration. Polyethersulfone was dissolved slowly in the liquid mixture at room temperature with agitation. A clear and homogeneous polymer dope formed.

The homogeneous polymer dope was filtered and introduced into a solution tank in a "moisture-free" environment. In order to prevent concentration change of each component in the polymer dope during the vacuum degassing process, the dope was degassed by a still method. The polymer dope was kept in the solution tank for 48 hours before use. During the membrane spinning process, the polymer dope was extruded through a spinnerette while tap water was simultaneously injected into the fiber lumen. The spinnerette is a single hole tube-in-orifice type. The temperatures of the spinnerette and tap water were maintained at room temperature (24–26° C.). The spinnerette was arranged such that the hollow fiber was extruded vertically downwards into the coagulation bath. The nascent fiber passed through an air gap of predetermined length before entering the coagulation bath. No nascent hollow fibers were extended by drawing. This means that the take-up velocity of the hollow fiber is nearly the same as the initial extrusion velocity. The hollow fiber was washed with a water spray for up to 3 days and then removed from the water bath and dried at room temperature. Each of the hollow fiber test cells consisted of six to twenty hollow fibers of 15–20 cm length. The hollow fibers were coated with a solution containing 3 wt % SYLGARD-184 and n-pentane.

Membrane Gas Permeation Test

Two hollow fiber test cells were made for each sample. The hollow fiber test cells were placed in a pressure vessel and immersed in a water bath at a controlled temperature. The permeation rates of pure helium, carbon dioxide, oxygen and nitrogen were measured at atmospheric pressure and room temperature using a soap optidigital flowmeter. The pressure difference across the hollow fiber was kept at 5 bar. The permeability was calculated using the equation:

$$J_i = \frac{Q_i}{n \times \pi \times OD \times L \times \Delta P \times 75} \tag{2}$$

Where $Q_i$ is the gas permeation flow rate (measured using volume flow meter) in $cm^3$ (STP)/s of pure gas i; n is the number of hollow fibers in the cell; OD is the outside diameter of the hollow fiber in cm; L is the length of the hollow fiber in cm; ΔP is the pressure difference across the membrane in bar. The subscript i is referred to as the species concerned. The ideal separation factor relative to nitrogen is the ratio of the gas permeability and the nitrogen permeability.

$$\frac{\alpha_i}{N_2} = \frac{J_i}{J_{N2}} \tag{3}$$

The following examples are for illustrative purposes only and do not limit the scope of the invention.

EXAMPLE 1

A polymer dope was prepared by dissolving polyethersulfone (VITREX® 4800P) in a solvent mixture of N-methyl-2-pyrrolidone and water (as a nonsolvent-additive) having a mass ratio of solvent/nonsolvent-additive of 8.38/1. The polymer concentration is 29.4 wt %. This polymer dope had a coagulation value of 3 g and viscosity of 46,786 cp at 25° C. Hollow fibers were prepared using the spinnerette with orifice diameter/inner diameter of the tube of 2.0/0.8 mm at different air-gap lengths. The prepared hollow fibers have an outer diameter of about 1800 μm and an inner diameter of 1200 μm. The permeabilities of helium, carbon dioxide, oxygen and nitrogen and their ideal separation factors relative to nitrogen were determined at a temperature of 50° C. and pressure difference of 5 bar. The results are given in Table 2. With decreasing air-gap length, the permeability only diminishes slightly. These hollow fibers exhibit higher permeability and ideal separation factors than those prepared from the solvent system containing propionic acid and N-methyl-2-pyrrolidone according to the U.S. Pat. No. 4,871,494. Although the same solvent and coagulant have been chosen for the preparation of the polyethersulfone hollow fiber membranes in the present invention. Example 1 clearly demonstrates the advantage of using water as nonsolvent-additive.

TABLE 2

| Air-gap | Permeability, GPU | | | | Ideal separation factor | | |
|---|---|---|---|---|---|---|---|
| length, cm | $J_{He}$ | $J_{CO2}$ | $J_{O2}$ | $J_{n2}$ | $He/N_2$ | $CO_2/N_2$ | $O_2/N_2$ |
| 22 | 200.7 | 85.5 | 18.9 | 3.24 | 63 | 26 | 5.8 |
| 15 | 194.4 | 81.0 | 18.0 | 3.06 | 64 | 27 | 5.9 |
| 10 | 180.0 | 78.3 | 17.1 | 3.15 | 57 | 25 | 5.4 |
| | — | — | — | 13.1* | | | 5.1* |

1 GPU = $1 \times 10^{-6}$ $cm^3$ (STP)/$cm^2$-cmHg-s

*U.S. Pat. No. 4,871,494

EXAMPLE 2

Three samples of dry-wet solidified polyethersulfone hollow fibers were prepared by the same process described in Example 1 with an air-gap length of 15 cm. Before drying, the hollow fibers were stored in water for about six months and then immersed in methanol (MeOH), ethanol (EtOH) and 2-propanol (2-PrOH), respectively for the three samples prepared, for 30 minutes, and then in n-pentane for 10 minutes. The treated hollow fibers were dried at room temperature and coated using 3 wt % coating solution. Permeabilities and ideal separation factors were determined using He, $CO_2$, $O_2$ and $N_2$ at 25° C., and the pressure difference of 5 bar. The results are shown in Table 3. The hollow fibers treated using aliphatic alcohols and n-pentane exhibit relatively high selectivity, particularly as to the separation factor of $O_2$ and $N_2$.

TABLE 3

| | Permeability, GPU | | | | Ideal separation factor | | |
|---|---|---|---|---|---|---|---|
| | $J_{He}$ | $J_{CO2}$ | $J_{O2}$ | $J_{N2}$ | $He/N_2$ | $CO_2/N_2$ | $O_2/N_2$ |
| MeOH | 135.5 | 45.0 | 8.6 | 1.06 | 127.8 | 42.5 | 8.1 |
| EtOH | 119.7 | 36.9 | 6.8 | 0.85 | 140.8 | 43.4 | 8.0 |
| 2-PrOH | 135.0 | 42.6 | 8.3 | 1.03 | 130.1 | 41.4 | 8.1 |

1 GPU = $1 \times 10^{-6}$ $cm^3$ (STP)/$cm^2$-cmHg-s

EXAMPLE 3

A polymer dope was prepared by dissolving polyethersulfone (RADEL A-300) in a solvent mixture of N-methyl-2-pyrrolidone and water (as a nonsolvent-additive) having a mass ratio of solvent/nonsolvent-additive of 8.38/1. The polymer concentration was 29.4 wt %. This polymer dope had a coagulation value of 3 g and viscosity of 29631 cp at 30° C. Hollow fibers were prepared using the spinnerette with orifice diameter/inner diameter of the tube of 1.0/0.21 mm and at air-gap lengths of 15 cm, 10 cm and 5 cm, respectively. The resulting hollow fibers have an outer diameter of about 850 $\mu$m and an inner diameter of 500 $\mu$m. The permeabilities of helium, carbon dioxide, oxygen and nitrogen and their ideal separation factors relative to nitrogen were determined at 50° C. and pressure difference of 5 bar. The results are given in Table 4.

TABLE 4

| Air-gap | Permeability, GPU | | | | Ideal separation factor | | |
|---|---|---|---|---|---|---|---|
| (cm) | $J_{He}$ | $J_{CO2}$ | $J_{O2}$ | $J_{N2}$ | $He/N_2$ | $CO_2/N_2$ | $O_2/N_2$ |
| 15 | 190.7 | 56.2 | 13.0 | 2.10 | 90.8 | 26.7 | 6.19 |
| 10 | 205.0 | 61.8 | 14.3 | 2.24 | 91.5 | 27.5 | 6.89 |
| 5 | 171.1 | 54.1 | 13.0 | 2.20 | 77.8 | 24.6 | 5.91 |

1 GPU = $1 \times 10^{-6}$ $cm^3$ (STP)/$cm^2$-cmHg-s

EXAMPLE 4

A polymer dope was prepared by dissolving polyethersulfone (RADEL A-300) in a solvent mixture of N-methyl-2-pyrrolidone and water (as a nonsolvent-additive) having a mass ratio of solvent/nonsolvent-additive of 8.38/1. The polymer concentration was 27 wt %. This polymer dope had a coagulation value of 3 g and viscosity of 13266 cp at 25° C. Hollow fibers were prepared using the spinnerette with orifice diameter/inner diameter of the tube of 1.0/0.21 mm and at air-gap lengths of 15 cm, 10 cm and 5 cm, respectively. The resulting hollow fibers have an outer diameter of about 850 $\mu$m and an inner diameter of 500 $\mu$m. The permeabilities of helium, carbon dioxide, oxygen and nitrogen and their ideal separation factors relative to nitrogen were determined at 50° C. and pressure difference of 5 bar. The results are given in Table 5.

TABLE 5

| Air-gap | Permeability, GPU | | | | Ideal separation factor | | |
|---|---|---|---|---|---|---|---|
| (cm) | $J_{He}$ | $J_{CO2}$ | $J_{O2}$ | $J_{N2}$ | $He/N_2$ | $CO_2/N_2$ | $O_2/N_2$ |
| 15 | 196.4 | 74.9 | 17.0 | 3.35 | 58.3 | 22.4 | 5.07 |
| 10 | 220.5 | 80.4 | 18.7 | 3.75 | 58.8 | 21.4 | 5.00 |
| 5 | 223.7 | 88.6 | 19.6 | 3.58 | 62.5 | 24.7 | 5.60 |

1 GPU = $1 \times 10^{-6}$ $cm^3$ (STP)/$cm^2$-cmHg-s

EXAMPLE 5

A polymer dope was prepared by dissolving polyethersulfone (RADEL A-300) in a solvent mixture of N-methyl-2-pyrrolidone and ethanol (as a nonsolvent-additive) having a mass ratio of solvent/nonsolvent-additive of 2.29/1. The polymer concentration was 27 wt %. This polymer dope had a coagulation value of 1.5 g and viscosity of 2767 cp at 25° C. The hollow fibers were prepared using the spinnerette with orifice diameter/inner diameter of the tube of 0.6/0.15 mm and at air-gap lengths of 10 cm, 5 cm and 2 cm, respectively. The resulting hollow fibers have an outer diameter of about 575 $\mu$m and an inner diameter of 300 $\mu$m. The permeabilities of helium, carbon dioxide, oxygen and nitrogen and their ideal separation factors relative to nitrogen were determined at 25° C. and pressure difference of 5 bar. The results are given in Table 6.

TABLE 6

| Air-gap | Permeability, GPU | | | | Ideal separation factor | | |
|---|---|---|---|---|---|---|---|
| (cm) | $J_{He}$ | $J_{CO2}$ | $J_{O2}$ | $J_{N2}$ | $He/N_2$ | $CO_2/N_2$ | $O_2/N_2$ |
| 10 | 79.1 | 45.4 | 5.3 | 0.74 | 107 | 45.4 | 7.1 |
| 5 | 97.0 | 45.9 | 6.7 | 1.37 | 70.8 | 33.5 | 4.9 |
| 2 | 110.0 | 60.4 | 9.0 | 2.55 | 43.1 | 23.7 | 3.5 |

1 GPU = $1 \times 10^{-6}$ $cm^3$ (STP)/$cm^2$-cmHg-s

EXAMPLE 6

A polymer dope was prepared by dissolving polyethersulfone (RADEL A-300) in a solvent mixture of N-methyl-2-pyrrolidone, water and ethanol having a mass ratio of N-methyl-2-pyrrolidone/water/ethanol of 8.7/1/1. The polymer concentration was 29.4 wt %. This polymer dope had a coagulation value of 3 g and viscosity of 17009 cp at 25° C. The hollow fibers were prepared using the spinnerette with orifice diameter/inner diameter of the tube of 0.6/0.15 mm and an air-gap length of 5 cm. The resulting hollow fibers have an outer diameter of about 600 $\mu$m and an inner diameter of 310 $\mu$m. The permeabilities of helium, carbon dioxide, oxygen and nitrogen and their ideal separation factors relative to nitrogen were determined at 50° C. and pressure difference of 5 bar. The results are given in Table 7.

TABLE 7

| Air-gap | Permeability, GPU | | | | Ideal separation factor | | |
|---|---|---|---|---|---|---|---|
| (cm) | $J_{He}$ | $J_{CO2}$ | $J_{O2}$ | $J_{N2}$ | $He/N_2$ | $CO_2/N_2$ | $O_2/N_2$ |
| 5 | 196.0 | 81.2 | 17.6 | 3.65 | 54.0 | 22.2 | 4.81 |

1 GPU = $1 \times 10^{-6}$ $cm^3$ (STP)/$cm^2$-cmHg-s

We claim:

1. A process for making an asymmetric hollow fiber membrane comprising:

(a) producing a polymer dope comprising a polyether sulfone or derivative thereof, and a solvent, by dissolving said polyether sulfone or derivative thereof in said solvent together with a non-solvent additive, wherein said polymer dope has a viscosity of 5000 to 50,000 centipoises at 25° C.;

(b) forming a nascent hollow fiber from said polymer dope;

(c) passing said nascent hollow fiber through an air gap; and (d) coagulating the nascent hollow fiber in a coagulation medium to form an asymmetric hollow fiber membrane.

2. The process of claim 1, which further comprises:

(e) desolvating the hollow fiber membranes in the coagulation medium;

(f) optionally treating the hollow fiber membrane with an organic non-solvent;

(g) drying the hollow fiber membranes; and (h) coating the dried hollow fiber membranes with a coating solution.

3. The process of claim 1, wherein the non-solvent additive is a polar compound that is liquid at room temperature.

4. The process of claim 1, wherein the non-solvent additive is selected from the group consisting of a $C_1$–$C_4$ alcohol, water, a mixture of $C_1$–$C_4$ alcohols and a mixture of at least one $C_1$–$C_4$ alcohol and water.

5. The process of claim 1, wherein the polymer dope comprises polyether sulfone.

6. The process of claim 5, wherein the non-solvent additive is selected from the group consisting of a $C_1$–$C_4$ alcohol, water, a mixture of $C_1$–$C_4$ alcohols and a mixture of at least one $C_1$–$C_4$ alcohol and water.

7. The process of claim 1, wherein the solvent is N-methyl-2-pyrrolidone or N,N-dimethylacetamide.

8. The process of claim 5, wherein the solvent is N-methyl-2-pyrrolidone or N,N-dimethylacetamide.

9. The process of claim 6, wherein the solvent is N-methyl-2-pyrrolidone or N,N-dimethylacetamide.

10. The process of claim 1, wherein the polymer dope has a coagulation value of 1 to 3 grams for water by the addition of the non-solvent additive.

11. The process of claim 6, wherein the polymer dope has a coagulation value of 1 to 3 grams for water by the addition of the non-solvent additive.

12. The process of claim 9, wherein the polymer dope has a coagulation value of 1 to 3 grams for water by the addition of the non-solvent additive.

13. The process of claim 1, wherein the non-solvent additive is selected from the group consisting of ethanol, water, and a mixture of ethanol and water.

14. The process of claim 5, wherein the non-solvent additive is selected from the group consisting of ethanol, water, and a mixture of ethanol and water.

15. The process of claim 7, wherein the non-solvent additive is selected from the group consisting of ethanol, water, and a mixture of ethanol and water.

16. The process of claim 13, wherein the non-solvent additive is selected from the group consisting of ethanol, water, and a mixture of ethanol and water.

17. The process of claim 1, wherein the coagulation medium is water.

18. The process of claim 1, wherein the hollow fiber-forming means is a tube-in-orifice spinnerette and water is introduced into the nascent hollow fiber as the hollow fiber is extruded from said spinnerette.

19. The process of claim 2, wherein said coating solution comprises polydimethylsiloxane and n-pentane.

* * * * *